US008858105B2

(12) United States Patent
Sugimura

(10) Patent No.: US 8,858,105 B2
(45) Date of Patent: Oct. 14, 2014

(54) LABEL CREATING DEVICE AND PROGRAM FOR CONTROLLING FEEDING OF PRINT MEDIUM

(71) Applicant: Yoshihiko Sugimura, Nagoya (JP)

(72) Inventor: Yoshihiko Sugimura, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/625,526

(22) Filed: Sep. 24, 2012

(65) Prior Publication Data

US 2013/0149019 A1 Jun. 13, 2013

(30) Foreign Application Priority Data

Dec. 9, 2011 (JP) ..... 2011-270464

(51) Int. Cl.
*B41J 11/66* (2006.01)
*B41J 11/70* (2006.01)

(52) U.S. Cl.
USPC ..... 400/621; 400/76; 400/583

(58) Field of Classification Search
CPC ..... B41J 11/663
See application file for complete search history.

(56) References Cited

U.S. PATENT DOCUMENTS

| | | | | |
|---|---|---|---|---|
| 6,146,035 | A | 11/2000 | Ishigouoka et al. | |
| 6,190,066 | B1 * | 2/2001 | Ishigouoka et al. | 400/120.01 |
| 2008/0310904 | A1 | 12/2008 | Yamaguchi et al. | |
| 2010/0329767 | A1 * | 12/2010 | Sago et al. | 400/613 |

FOREIGN PATENT DOCUMENTS

| | | | | |
|---|---|---|---|---|
| CN | 1550347 | | 12/2004 | |
| CN | 101060988 | | 10/2007 | |
| CN | 101081575 | | 12/2007 | |
| JP | 04-152161 | | 5/1992 | |
| JP | 04152161 A | * | 5/1992 | B41J 11/42 |
| JP | 2003-094703 A | | 4/2003 | |
| JP | 2003-118151 A | | 4/2003 | |
| JP | 4039917 | | 1/2008 | |
| JP | 4443760 | | 3/2010 | |

OTHER PUBLICATIONS

Office Action issued in Chinese Application No. 201210484239.1 on Jul. 1, 2014.

* cited by examiner

*Primary Examiner* — Daniel J Colilla
*Assistant Examiner* — Justin Olamit
(74) *Attorney, Agent, or Firm* — McCarter & English, LLP

(57) ABSTRACT

A label creation device includes a feeding portion configured to feed a printing medium in a first direction and a second direction, the second direction being an opposite direction from the first direction, a printing portion configured to perform printing on the printing medium fed in the first direction, a cutting portion configured to cut the printing medium, the printed portion being a portion of the printing medium on which the printing has been performed, and a processor configured to specify a first distance, which is a length of a blank portion, the cut position being a position of the printing medium where the printing medium is cut, and control the feeding portion to feed the printing medium in the second direction in a case where a second distance is greater than the first distance, the second distance being a distance between the printing portion and the cutting portion.

12 Claims, 13 Drawing Sheets

LABEL CREATING DEVICE AND PROGRAM FOR CONTROLLING FEEDING OF PRINT MEDIUM

CROSS-REFERENCE TO RELATED APPLICATION

This application claims priority to Japanese Patent Application No. 2011-270464, filed Dec. 9, 2011, the content of which is hereby incorporated herein by reference.

BACKGROUND

The present disclosure relates to a label creation device that creates a label by performing printing on a tape and then cutting the printed tape, and to a non-transitory computer-readable medium that stores a control program executable on the label creation device.

The label creation device may print a character or the like on the tape that is the printing medium. Then the label creation device may cut the printed tape. Thus the label creation device may create the label. The label creation device includes a print head and a cutting blade. The print head may perform the printing. The cutting blade is provided on the downstream side of the print head in the direction in which the tape is fed. By cutting the tape, the cutting blade may cut off the printed portion of the tape. The portion that has been cut off is equivalent to the label.

A blank area where a character or the like is not printed may be formed at the leading end of the created label. A gap is provided between the print head and the cutting blade. Therefore, in a case where the printing and the cutting are performed repeatedly, printing may not be performed on the portion of the tape between the print head and the portion where the tape has been cut. To deal with this, a technology is known that, after the printed tape has been cut and the label has been created, and before the next printing starts, feeds the tape in the reverse direction from the direction the tape is fed during the printing. With this technology, the point where the tape was cut may be returned to the position of the print head by the feeding of the tape in the reverse direction. Then the printing may be performed in the vicinity of the point where the tape was cut, that is, at the leading end of the label. The label creation device may thus be inhibited from forming a blank area at the leading end of the label.

SUMMARY

In a case where the technology that is described above is used, the tape may be always fed in the reverse direction before the printing starts, even in a case where the printing is to be performed such that a blank area is intentionally provided at the leading end of the label. Therefore, the time that is required in order to feed the tape in the reverse direction may become extra time. Accordingly, the label may not be created in a short time.

Embodiments of the broad principles derived herein provide a label creation device and a non-transitory computer-readable medium that stores a control program executable on the label creation device that are capable of creating a label in a short time by appropriately inhibiting the forming of a blank area at the leading end of the label.

Embodiments provide a label creation device that includes a feeding portion, a printing portion, a cutting portion, and a processor. The feeding portion is configured to feed a printing medium in a first direction and a second direction. The second direction is an opposite direction from the first direction. The printing portion is configured to perform printing on the printing medium fed in the first direction by the feeding portion. The cutting portion is provided downstream in the first direction from the printing portion, and is configured to cut the printing medium in order to create a label by cutting off a printed portion of the printing medium that is fed by the feeding portion. The printed portion is a portion of the printing medium on which the printing has been performed by the printing portion. The processor is configured to specify a first distance, which is a length of a blank portion in the first direction. The blank portion is a portion of the printing medium on which the printing is not performed and that is provided downstream in the second direction from a cut position. The cut position is a position of the printing medium where the printing medium is cut by the cutting portion. The processor is further configured to control the feeding portion to feed the printing medium in the second direction in a case where a second distance is greater than the first distance that has been specified. The second distance is a distance between the printing portion and the cutting portion.

Embodiments also provide a non-transitory computer-readable medium storing a control program executable on a label creation device. The program includes computer-readable instructions, when executed, to cause the label creation device to perform the step of specifying a first distance, which is a length of a blank portion in a first direction. The blank portion is a portion of a printing medium on which printing is not performed by a printing portion of the label creation device and that is provided downstream in the second direction from a cut position. The cut position is a position of the printing medium where the printing medium is cut by a cutting portion of the label creation device. A feeding portion is configured to feed a printing medium in the first direction and a second direction. The second direction is an opposite direction from the first direction. The printing portion is configured to perform printing on the printing medium fed in the first direction by the feeding portion. The cutting portion is provided downstream in the first direction from the printing portion and is configured to cut the printing medium in order to create a label by cutting off a printed portion of the printing medium that is fed by the feeding portion. The printed portion is a portion of the printing medium on which the printing has been performed by the printing portion. The program further includes computer-readable instructions, when executed, to cause the label creation device to perform the step of controlling the feeding portion to feed the printing medium in the second direction in a case where a second distance is greater than the first distance that has been specified. The second distance is a distance between the printing portion and the cutting portion.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings.

Figure 1:
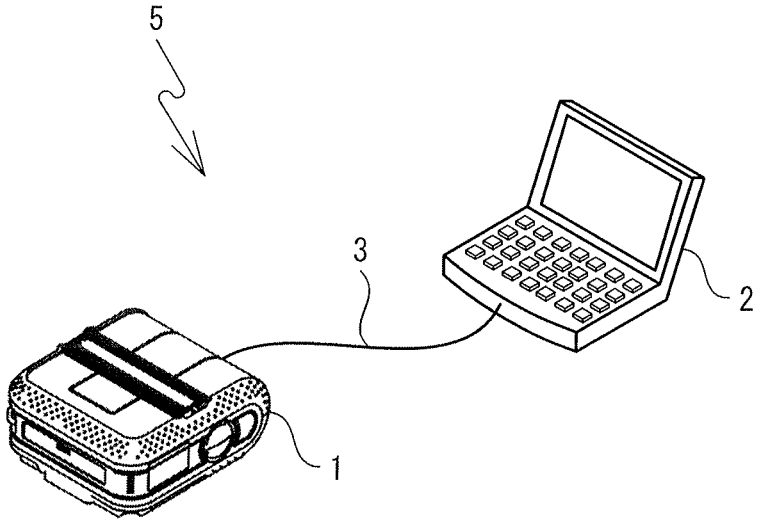
FIG. 1 is a figure that shows an overview of a label creation system 5.

An overview of a label creation system 5 will be explained with reference to FIG. 1. The label creation system 5 includes a label creation device 1 and an external terminal 2. The label creation device 1 and the external terminal 2 may be connected by a USB (registered trademark) cable 3. The label creation device 1 may print a character, a graphic, or the like on a heat-sensitive tape 8 (refer to FIG. 6 and the like), which is a printing medium. An object, such as a character, a graphic, or the like, to be printed on the heat-sensitive tape 8 is hereinafter also referred to as a print object. Then the label creation device 1 may cut off the portion of the heat-sensitive tape 8 on which the print object has been printed. The label creation device 1 may thus create a label. The label creation device 1 may create the label by operating based on print data that have been received from the external terminal 2. The external terminal 2 is a general-purpose personal computer. The external terminal 2 may create the print data that are required in order for the label creation device 1 to create a label. A user may edit the print data via a keyboard or a mouse of the external terminal 2.

The configuration of the label creation device 1 will be explained with reference to FIGS. 2 to 4. The lower right, the upper left, the upper right, the lower left, the upward direction, and the downward direction in FIG. 2 are respectively defined as the right, the left, the rear, the front, the top, and the bottom of the label creation device 1.

Figure 2:
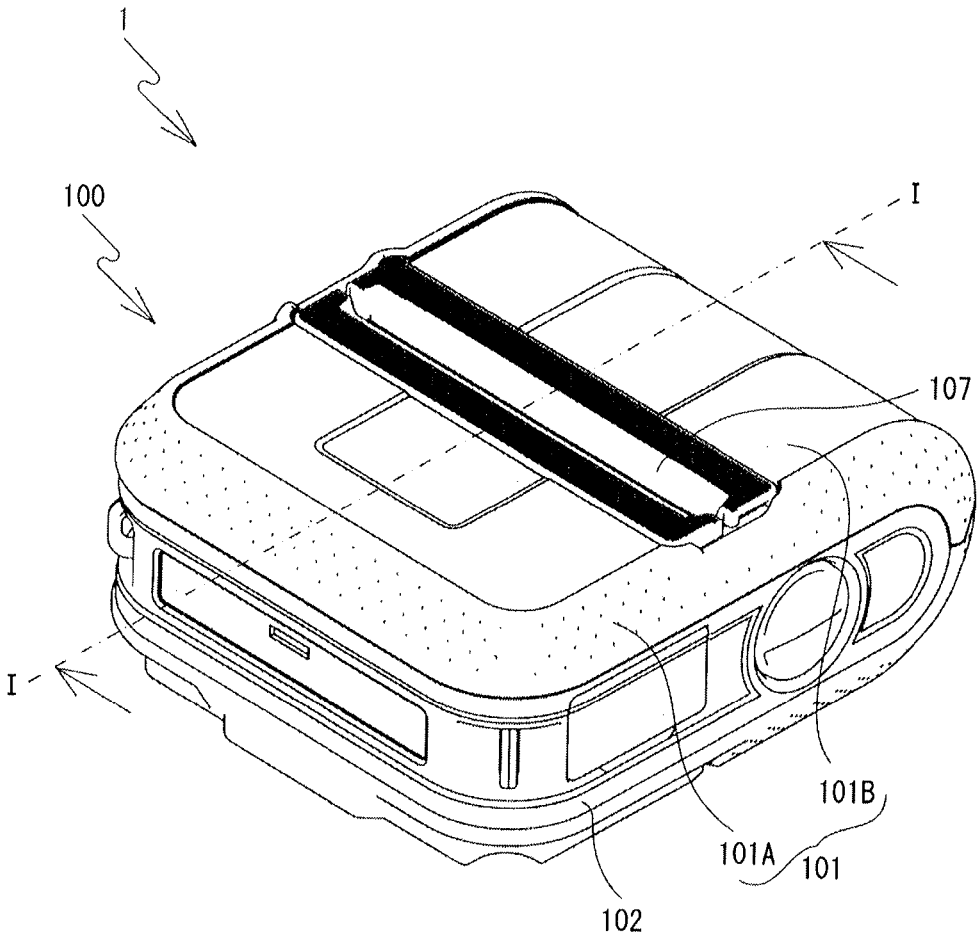
FIG. 2 is an oblique view of a label creation device 1.

As shown in FIG. 2, the label creation device 1 includes a housing 100. The housing 100 is approximately box-shaped. The housing 100 includes a top cover 101 and a bottom cover 102. The top cover 101 is provided on the top face of the housing 100. The bottom cover 102 is provided on the bottom face of the housing 100. The top cover 101 includes a fixed portion 101A and an opening-closing portion 101B. The fixed portion 101A is the front portion of the top cover 101. The opening-closing portion 101B is the rear portion of the top cover 101.

Figure 3:
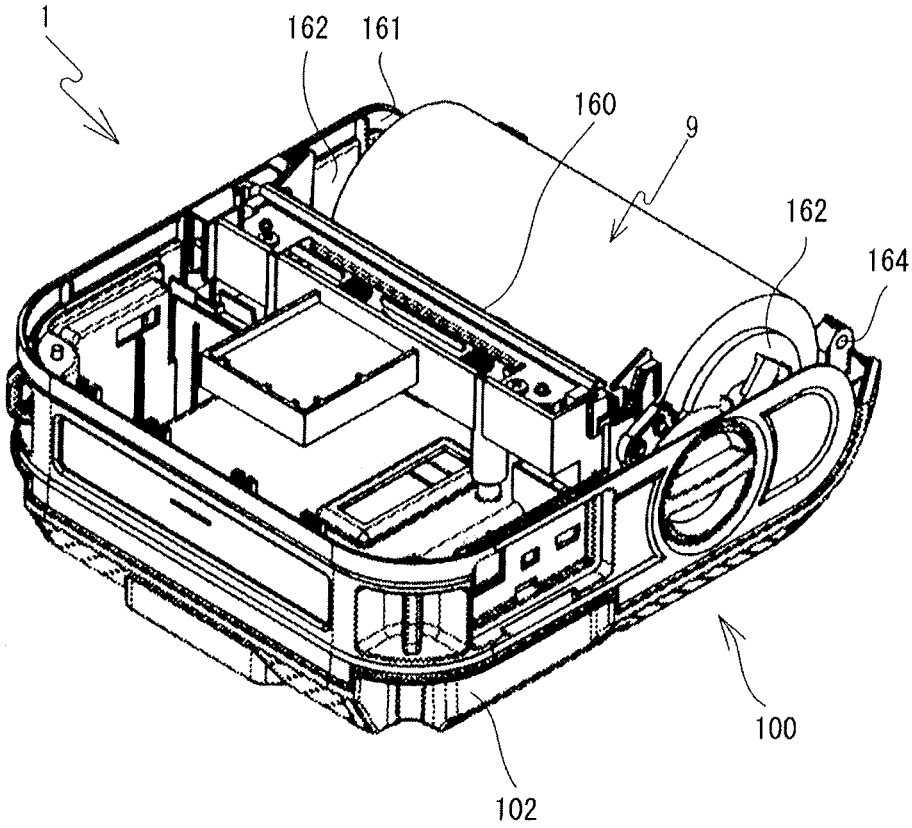
FIG. 3 is an oblique view that shows the label creation device 1 in a state in which a top cover 101 has been removed.

As shown in FIG. 3, a roll containing portion 161 is provided underneath the opening-closing portion 101B (refer to FIG. 2). A roll 9, around which the heat-sensitive tape 8 (refer to FIG. 6 and the like) is wound, may be contained in the roll containing portion 161. Supporting members 162 may be attached to both ends of the roll 9. The roll 9 may be supported by the supporting members 162 such that the roll 9 can be rotated. This makes it possible to supply the heat-sensitive tape 8 continuously from the roll containing portion 161. The rear edge of the opening-closing portion 101B is rotatably supported by a hinge 164. The opening-closing portion 101B may be opened and closed by swinging its front edge up and down around the rear edge as its axis. With the opening-closing portion 101B in the open state, the roll containing portion 161 may be exposed. The user may therefore perform mounting and replacement of the roll 9 easily.

Figure 4:
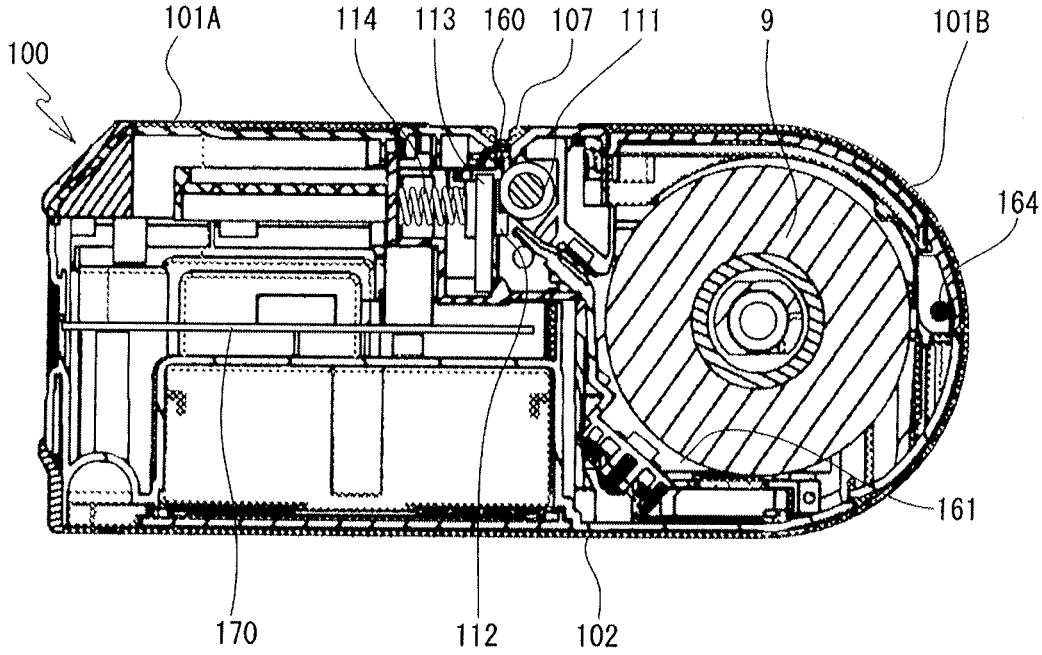
FIG. 4 is a sectional view in the direction of a line I-I in FIG. 2.

As shown in FIG. 4, a discharge outlet 107 is provided between the fixed portion 101A and the opening-closing portion 101B, approximately in the center of the top cover 101 (refer to FIG. 2) in the front-rear direction. The portion of the heat-sensitive tape 8 on which the printing has been performed may pass from the inside to the outside of the housing 100 through the discharge outlet 107. The heat-sensitive tape 8 is thus discharged from the inside to the outside of the housing 100. A platen roller 111 is rotatably supported at the front edge of the opening-closing portion 101B. A drive motor (not shown in the drawings) is provided inside the housing 100. The drive motor is connected to the platen roller 111 via a gear train (not shown in the drawings). A control board 170 is provided in the front portion of the interior of the housing 100. The operation of the drive motor is controlled by a CPU 11 (refer to FIG. 5) on the control board 170. The rotational driving force of the drive motor may be transmitted to the platen roller 111, and the platen roller 111 may be rotated.

A thermal line head 112, a fixed plate 113, and a spring 114 are provided below the rear edge of the fixed portion 101A. The fixed plate 113 is provided in front of the platen roller 111. The fixed plate 113 extends in the left-right direction in a state in which its faces are oriented in the front-rear direction. The thermal line head 112 is provided on the rear face of the fixed plate 113. The thermal line head 112 extends in the left-right direction. The thermal line head 112 has a structure in which heating elements for a single line of an image that is to be formed on the heat-sensitive tape 8 are arrayed in a scanning direction (the left-right direction). The heating elements of thermal line head 112 may generate heat by applying an electric current to the heating elements. The spring 114 biases the fixed plate 113 toward the rear.

A cutting blade 160 is provided above the thermal line head 112. The cutting blade 160 extends along the discharge outlet 107. The user may cut the heat-sensitive tape 8 manually by pulling the heat-sensitive tape 8 that has been discharged from the discharge outlet 107 toward the front and pressing the heat-sensitive tape 8 against the cutting blade 160.

The process in which a label 7 (refer to FIG. 7) is created will be explained. The heat-sensitive tape 8 may be inserted between the platen roller 111 and the thermal line head 112 from the bottom toward the top. The heat-sensitive tape 8 may extend from the roll 9 that is contained in the roll containing portion 161. The spring 114 biases the fixed plate 113 toward the rear. This causes the thermal line head 112 to press the heat-sensitive tape 8 against the platen roller 111 with a specified force. As the drive motor turns, the platen roller 111 may be rotated. This causes the heat-sensitive tape 8 to be sequentially fed out from the roll 9 and to be fed upward from below. Hereinafter, the direction upward from below is also referred to as the first direction. The rotational direction in which the platen roller 111 rotates in order to feed the heat-sensitive tape 8 in the first direction is referred to as the forward direction. The heating elements of the thermal line head 112 may generate heat. This causes a print object to be printed on the heat-sensitive tape 8. The discharge outlet 107 is located on the downstream side of the platen roller 111 and the thermal line head 112 in the first direction. The printed heat-sensitive tape 8 may be discharged from the discharge outlet 107 to the outside of the housing 100. The discharged heat-sensitive tape 8 may be cut by the cutting blade 160 that is provided along the discharge outlet 107. The label 7 (refer to FIG. 7) may thus be created.

Figure 5:
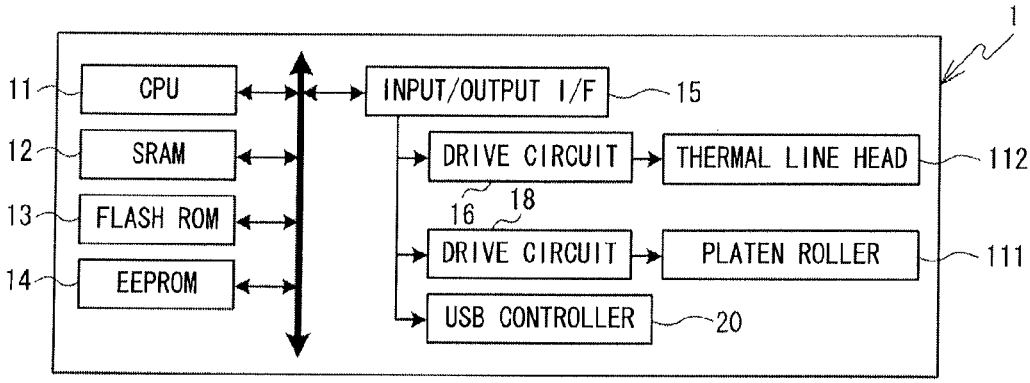
FIG. 5 is a block diagram that shows an electrical configuration of the label creation device 1.

The electrical configuration of the label creation device 1 will be explained with reference to FIG. 5. The label creation device 1 includes the CPU 11, an SRAM 12, a flash ROM 13 an EEPROM 14, an input/output interface (I/F) 15, drive circuits 16, 18, the thermal line head 112, the platen roller 111, and a USB controller 20. The CPU 11, the SRAM 12, the flash ROM 13, the EEPROM 14, the input/output I/F 15, the drive circuits 16, 18, and the USB controller 20 are mounted on the control board 170 (refer to FIG. 4).

The CPU 11 performs overall control of the label creation device 1. The flash ROM 13 is a rewriteable non-volatile storage element. The flash ROM 13 may store a control program and the like. The SRAM 12 may temporarily store the print data that have been received from the external terminal 2. The input/output I/F 15 is inserted between the CPU 11 on one side and the drive circuits 16, 18 and the USB controller 20 on the other side. The input/output I/F 15 may transmit data and a control signal. The drive circuit 16 may drive the thermal line head 112. The drive circuit 18 may drive the platen roller 111. The USB controller 20 is a device that may be used for performing communication with the external terminal 2 via the USB cable 3.

Figure 6:
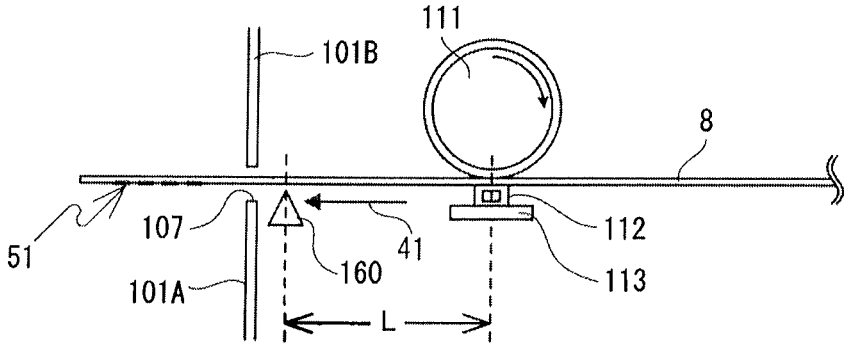
FIG. 6 is a figure that shows a way in which a heat-sensitive tape 8 is fed.

A known method of controlling the feeding of the heat-sensitive tape 8 will be explained with reference to FIGS. 6 to 9. As shown in FIGS. 6 to 9, a case is considered in which the thermal line head 112 and the cutting blade 160 are separated by a distance L. The distance L may be approximately 7 millimeters, for example. As shown in FIG. 6, first, in a state in which the heat-sensitive tape 8 is pinched between the platen roller 111 and the thermal line head 112, the platen roller 111 may be rotated in the forward direction. The heat-sensitive tape 8 may be fed out from the roll 9 (refer to FIG. 3) and may be fed in the first direction (indicated by an arrow 41) by the rotating of the platen roller 111. While the platen roller 111 is rotated, the heating elements of the thermal line head 112 may generate heat. Based on the print data that have been received from the external terminal 2 (refer to FIG. 5), a print object 51 may be printed sequentially on the heat-sensitive tape 8. The portion of the heat-sensitive tape 8 on which the print object 51 have been printed may pass through to the rear (the upward direction in FIG. 6) of the cutting blade 160, which is on the downstream side of the platen roller 111 and the thermal line head 112 in the first direction. Hereinafter, the portion of the heat-sensitive tape 8 on which the print object 51 have been printed is referred to as the printed portion of the heat-sensitive tape 8. The printed portion of the heat-sensitive tape 8 may pass through the discharge outlet 107, which is on the downstream side of the cutting blade 160 in the first direction, and may be discharged to the outside of the label creation device 1.

In a case where all of the printing that is based on the print data has been performed, the rotation of the platen roller 111 stops. The heat-sensitive tape 8 may be stopped in a state in which the printed portion of the heat-sensitive tape 8 is exposed to the outside of the label creation device 1.

Figure 7:
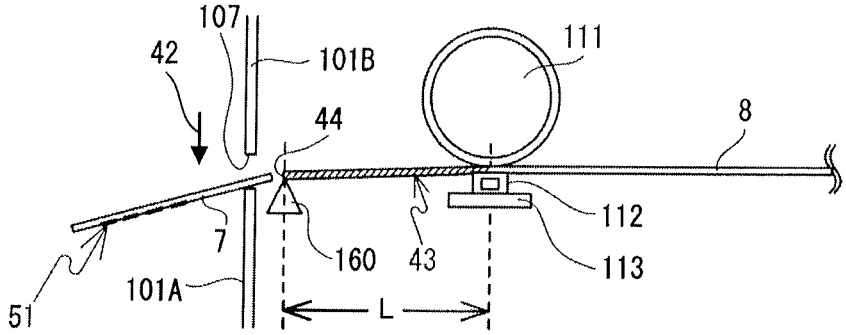
FIG. 7 is a figure that shows a way in which a label 7 is created.

As shown in FIG. 7, the user, in order to cut off the printed portion of the heat-sensitive tape 8, may pull the portion of the heat-sensitive tape 8 that is exposed to the outside of the label creation device 1 toward the front (the downward direction in FIG. 7) (indicated by an arrow 42). The heat-sensitive tape 8 may be pressed against and may be cut by the cutting blade 160, which is on the front side of the heat-sensitive tape 8. The printed portion of the heat-sensitive tape 8 may be cut off. The portion that is cut off is equivalent to the label 7. In this manner, the label 7 may be formed.

A case is considered in which printing on the heat-sensitive tape 8 is performed repeatedly. The portion of the heat-sensitive tape 8 where the heat-sensitive tape 8 was cut by the cutting blade 160 is a leading end 44. In the state in which the label 7 has been cut off from the heat-sensitive tape 8, the portion of the heat-sensitive tape 8 between the leading end 44 and the point where the platen roller 111 and the thermal line head 112 are in contact with the heat-sensitive tape 8 is a portion 43. In the state in which the label 7 has been cut off from the heat-sensitive tape 8, the portion 43 may be positioned on the downstream side of the platen roller 111 and the thermal line head 112 in the first direction. Therefore, after the label 7 has been cut off from the heat-sensitive tape 8, in order to perform printing on the portion 43, it is necessary to feed the heat-sensitive tape 8 in the opposite direction from the first direction. Hereinafter, the opposite direction from the first direction is referred to as the second direction.

Figure 8:
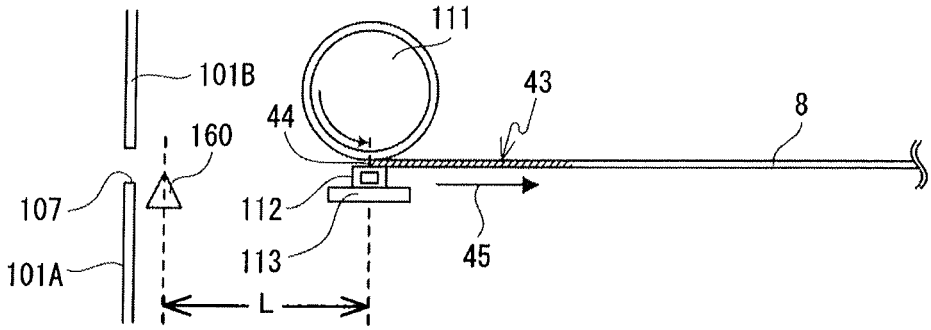
FIG. 8 is a figure that shows a way in which the heat-sensitive tape 8 is fed.

With the known method, control of the feeding of the heat-sensitive tape 8 may be performed as hereinafter described. A sequence of printing processing on the heat-sensitive tape 8 may be completed, and the label 7 may be cut off from the heat-sensitive tape 8. Then, as shown in FIG. 8, the platen roller 111 may be rotated in a direction that is the reverse of the forward direction. Hereinafter, the rotation direction that is the reverse of the forward direction is referred to as the reverse direction. Due to the rotation of the platen roller 111, the heat-sensitive tape 8 may be fed in the second direction (indicated by an arrow 45) by the distance L. After the heat-sensitive tape 8 is fed, the rotation of the platen roller 111 may be stopped. The heat-sensitive tape 8 may be stopped in a state in which the platen roller 111 and the thermal line head 112 are in contact with the leading end 44. It thus becomes possible for printing to be performed on the portion 43 of the heat-sensitive tape 8, starting from the leading end 44.

Actually, the amount that the heat-sensitive tape 8 is fed in the second direction may be a slightly shorter distance than the distance L. This may inhibit the leading end 44 of the heat-sensitive tape 8 from feeding to the downstream side of the platen roller 111 and the thermal line head 112 in the second direction, which would make it impossible for the platen roller 111 to feed the heat-sensitive tape 8. Specifically, in a case where the distance L is 7 millimeters, for example, the amount that the heat-sensitive tape 8 is fed in the second direction may be 6 millimeters.

Figure 9:
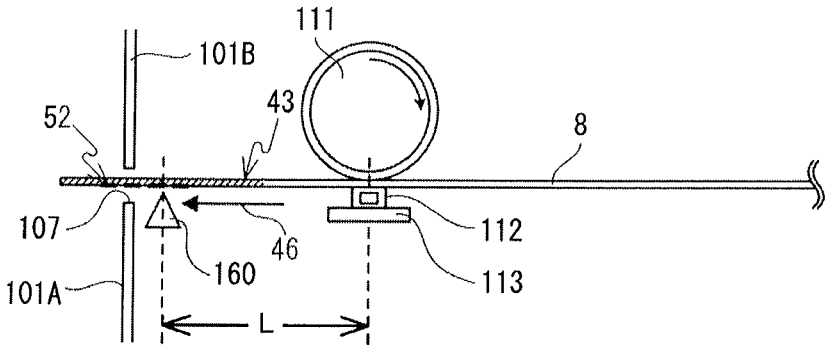
FIG. 9 is a figure that shows a way in which the heat-sensitive tape 8 is fed.

Next, as shown in FIG. 9, the platen roller 111 may start to be rotated in the forward direction. The heat-sensitive tape 8 may be fed in the first direction (indicated by an arrow 46) by the rotating of the platen roller 111. While the platen roller 111 is rotated, the heating elements of the thermal line head 112 may generate heat. A print object 52 may thus be printed sequentially on the heat-sensitive tape 8. The heat-sensitive tape 8 may be fed in the first direction, and printing may be performed on the portion 43. Therefore, the printing (of the print object 52) on the portion 43 may be performed as necessary, based on the print data. The printed portion of the heat-sensitive tape 8 may pass through to the rear (the upward direction in FIG. 9) of the cutting blade 160. Then the printed portion of the heat-sensitive tape 8 may pass through the discharge outlet 107 and may be discharged to the outside of the label creation device 1.

With the known method for controlling the feeding of the heat-sensitive tape 8, as described above, after a sequence of printing processing on the heat-sensitive tape 8 is completed and the label 7 has been created, printing may continue to be performed on the heat-sensitive tape 8. In this case, the heat-sensitive tape 8 may be fed by the distance L in the second direction before the printing is started. This makes it possible for the label creation device 1 to perform the printing starting from the leading end 44 of the heat-sensitive tape 8. Then the operating of the platen roller 111 and the thermal line head 112 may be started, and the printing may be performed on the heat-sensitive tape 8.

Figure 10:
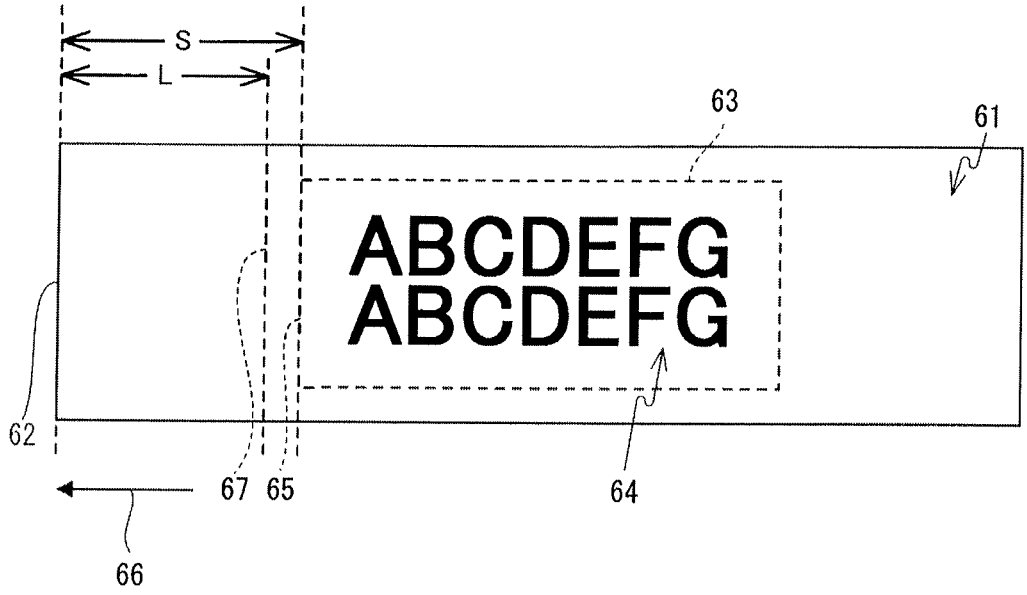
FIG. 10 is a figure that shows a label 61.

A case is considered in which the print data for creating a label 61 that is shown in FIG. 10 have been created by the external terminal 2. The print data include information (hereinafter referred to as the first information) that indicates the specific characters that is to be printed as a print object, the font, the size, and the layout of the characters, and the position of the print object in relation to the label. The print data also include information (hereinafter referred to as the second information) that indicates the direction in which the heat-sensitive tape 8 is to be fed when the printing is performed, that is, the first direction. The print data further include information (hereinafter referred to as the third information) that specifies a printable area within the label in terms of distances from the edges of the label. In the case of the label 61 that is shown in FIG. 10, the first information may be information for a print object 64 and includes, for example, the specific characters that is to be printed (ABCDEFG), the font (Gothic), the size (in points), and the layout (two rows) of the characters, and the position of the print object in relation to the label 61 (the distance (mm) from the top edge, the distance (mm) from the bottom edge, the distance (mm) from the left edge, the distance (mm) from the right edge). The second information may be the first direction (for example, to the left) (indicated by an arrow 66). The third information may specify a printable area 63, using a distance (mm) from the top edge, a distance (mm) from the bottom edge, a distance S (mm) from the left edge, and a distance (mm) from the right edge, for example. The first information, the second information, and the third information may be input through one of the keyboard and the mouse of the external terminal 2 (refer to FIG. 1).

The distance S may be the distance from a first direction downstream edge 62 of the label 61 to a first direction downstream edge 65 of the printable area 63. Here, the distance S may be greater than the distance L (refer to FIG. 6 and the like) between the thermal line head 112 (refer to FIG. 6 and the like) and the cutting blade 160 (refer to FIG. 6 and the like). A case is considered in which the printing of the print object 64 based on the print data is started in a state in which the heat-sensitive tape 8 is disposed in a position that corresponds to that shown in FIG. 7. In this case, the printable area 63 may be located on the upstream side of the platen roller 111 and the thermal line head 112 in the first direction (the opposite direction from the direction indicated by the arrow 66 in FIG. 10). It is assumed that, based on the known feeding control method that is described above, the heat-sensitive tape 8 is fed by the distance L in the second direction before the print object 64 is printed (refer to FIG. 8). In this case, the printing on the heat-sensitive tape 8 may not be performed after the heat-sensitive tape 8 is fed. Then the heat-sensitive tape 8 may be fed in the first direction by the distance S, which is greater than the distance L. This may create a state in which the first direction downstream edge 65 of the printable area 63 is positioned at the thermal line head 112. Then the heat-sensitive tape 8 may be fed even farther in the first direction (refer to FIG. 9). As the heat-sensitive tape 8 is fed, the printing of the print object 64 on the heat-sensitive tape 8 may be performed by the thermal line head 112.

As described above, the heat-sensitive tape 8 may be fed by the distance L in the second direction, and then, as the heat-sensitive tape 8 may be fed by the distance S in the first direction, the printing processing by the thermal line head 112 may not be performed. Therefore, in a case where the distance S is greater than the distance L, as it is for the label 61, the processing that feeds the heat-sensitive tape 8 in the second direction by the distance L and the processing that feeds the heat-sensitive tape 8 in the first direction by the distance S may both be unnecessary. Accordingly, the time that is required in order to perform these feeding processes may be superfluous. The length of time until the label 61 is created may thereby be increased.

In the present embodiment, in a case where the distance S and the distance L are compared and the distance L is not greater than the distance S, the feeding of the heat-sensitive tape 8 in the second direction is prohibited. That is, after the label 7 has been cut off from the heat-sensitive tape 8, as shown in FIG. 7, the heat-sensitive tape 8 may not be fed in the second direction (indicated by the arrow 45) as shown in FIG. 8. While the heat-sensitive tape 8 continues to be fed in the first direction (indicated by the arrow 46) as shown in FIG. 9, the printing of the print object 64 may be performed by the thermal line head 112. It is thus possible to shorten the time that is required for the processing that feeds the heat-sensitive tape 8 in the second direction by the distance L (refer to FIG. 8) and the processing that feeds the heat-sensitive tape 8 in the first direction by the distance S. The time that is required in order for the label creation device 1 to create the label 61 may therefore be shortened.

Main processing that is performed by the CPU 11 of the label creation device 1 will be explained with reference to FIG. 11 by assuming that the label 61 in FIG. 10 is to be created. The program for performing the main processing may be stored in the flash ROM 13 (refer to FIG. 5), for example. In a case where a command to create a label is issued to the label creation device 1, the main processing is started and performed by the CPU 11. First, the CPU 11 may receive the print data from the external terminal 2 via the USB cable 3 (refer to FIG. 1) (Step S11). The CPU 11 stores the print data that has been received from the external terminal 2 in the SRAM 12 (refer to FIG. 5). The CPU 11 specifies the distance S from the first direction downstream edge 62 of the label 61 to the first direction downstream edge 65 of the printable area 63 by referring to the third information that is included in the print data (Step S13).

The CPU 11 compares the distance S that was specified at Step S13 to the distance L between the thermal line head 112 (refer to FIG. 6 and the like) and the cutting blade 160 (refer to FIG. 6 and the like) (Step S15). In the case of the label 61 in FIG. 10, the distance S is not less than the distance L (NO at Step S15). Therefore, the processing advances to Step S19, without performing the processing that feeds the heat-sensitive tape 8 in the second direction by the distance L (refer to FIG. 8 and the like). In contrast, in a case where the distance S is less than the distance L (YES at Step S15), unlike in the case of the label 61, it is necessary to feed the heat-sensitive tape 8 in the second direction so that it may be possible to perform printing on the portion 43 (refer to FIGS. 7, 8), which is close to the leading end 44 of the heat-sensitive tape 8. The CPU 11 causes the platen roller 111 (refer to FIG. 6 and the like) to be rotated in the reverse direction and causes the heat-sensitive tape 8 to be fed in the second direction by the distance L (Step S17). The heat-sensitive tape 8 may enter a state in which the platen roller 111 and the thermal line head 112 are in contact with the leading end 44 (refer to FIG. 8). Then the processing advances to Step S19.

The print data may be stored in the SRAM 12. In order to perform the printing of the print object 64 based on the first information that is included in the print data, the CPU 11 causes the platen roller 111 to be rotated in the forward direction and causes the heat-sensitive tape 8 to be fed in the first direction (Step S19). The CPU 11 also causes the heating elements of the thermal line head 112 to be heated based on the first information. The print object 64 may thus be printed on the heat-sensitive tape 8 (Step S21). The portion of the heat-sensitive tape 8 on which the print object 64 has been printed may be discharged from the discharge outlet 107 (refer to FIG. 6 and the like) to the outside of the label creation device 1. Once the printing of the print object 64 has been completed, the CPU 11 stops the rotating of the platen roller 111 (Step S23). The heat-sensitive tape 8 may be stopped in a state in which the printed portion of the heat-sensitive tape 8 is exposed to the outside from the discharge outlet 107 (refer to FIG. 6). The main processing is terminated.

To cut off the printed portion of the heat-sensitive tape 8, the user may pull toward the front (the downward direction in FIG. 7) the portion of the heat-sensitive tape 8 that is exposed to the outside from the discharge outlet 107 (refer to FIG. 7). The heat-sensitive tape 8 may be pressed against the cutting blade 160 that is in front of the heat-sensitive tape 8 and may be cut. The printed portion of the heat-sensitive tape 8 may be cut off, and the label 61 may be created.

As explained above, based on the relationship between the distance S and the distance L, the label creation device 1 determines whether or not to feed the heat-sensitive tape 8 in the second direction before starting the printing. In a case where the distance L is not greater than the distance S, the label creation device 1 determines that the processing that feeds the heat-sensitive tape 8 in the second direction is unnecessary. In this case, therefore, the label creation device 1 does not feed the heat-sensitive tape 8 in the second direction. Thus the label creation device 1 may shorten the time that is required in order to create the label 61. In a case where the distance L is greater than the distance S, the heat-sensitive tape 8 is fed in the second direction by the distance L before the printing is started. Therefore, the label creation device 1 may perform appropriately the processing that feeds the heat-sensitive tape 8 in the second direction. The label creation device 1 may thus create a label that is printed right up to the edge.

The label creation device 1 specifies the distance from the first direction downstream edge 62 of the label 61 to the first direction downstream edge 65 of the printable area 63 as the distance S. The printable area 63 may be a parameter that the user inputs directly to the external terminal 2. Therefore, the label creation device 1 may specify the distance S easily.

In a case where the label creation device 1 feeds the heat-sensitive tape 8 in the second direction prior to the printing, the label creation device 1 consistently defines the amount that the heat-sensitive tape 8 is fed as the distance L. This makes it possible for the label creation device 1 to consistently specify the amount of rotation in a case where the platen roller 111 is to be rotated in the reverse direction. The label creation device 1 may therefore simplify the control by the CPU 11 and reduce the processing burden. In addition, the label creation device 1 may feed the heat-sensitive tape 8 by the distance L in the second direction prior to the printing. This makes it possible for the label creation device 1 to feed the heat-sensitive tape 8 to a position where the leading end 44 of the heat-sensitive tape 8 is to be in contact with the thermal line head 112. The label creation device 1 may therefore reliably perform printing starting from the leading end 44 of the heat-sensitive tape 8 and may create a label on which a print object are printed at the leading end.

The present disclosure is not limited to the embodiment that is described above, and various types of modifications may be possible. In the embodiment that is described above, the distance from the first direction downstream edge 62 of the label 61 to the first direction downstream edge 65 of the printable area 63 is specified as the distance S, which is compared to the distance L. As an alternative to this, the label creation device 1 may specify a parameter that is different from the distance S and compare that parameter to the distance L. The label creation device 1 may use the comparison to determine whether or not to feed the heat-sensitive tape 8 in the second direction before starting the printing. For example, the parameter that is compared to the distance L may be specified as shown in FIG. 12.

Figure 12:
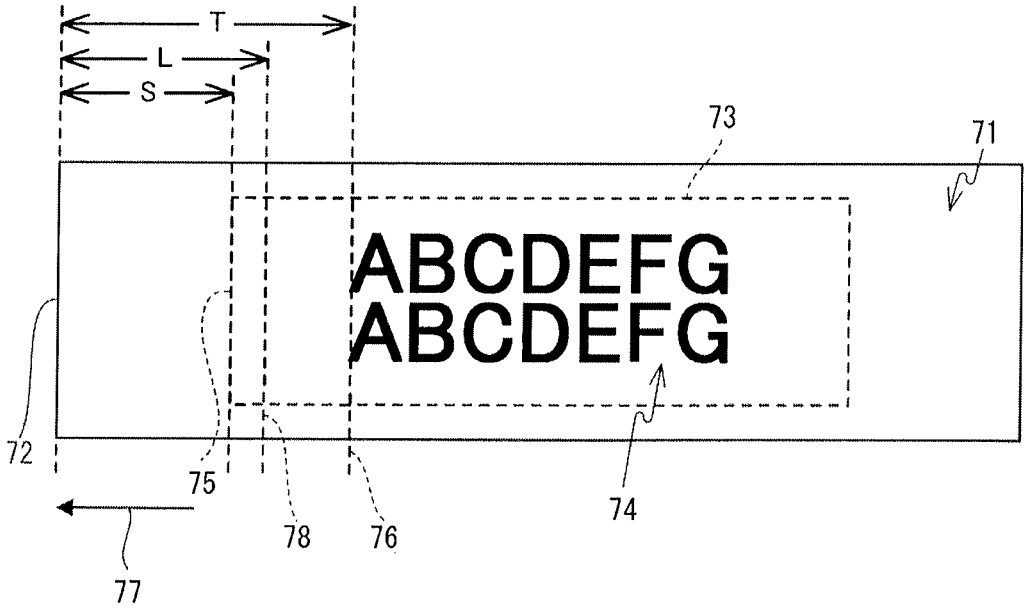
FIG. 12 is a figure that shows a label 71.

For example, a case is considered that print data for creating a label 71, as shown in FIG. 12, have been created by the external terminal 2. In the same manner as the print data for the label 61 (refer to FIG. 10), the print data for the label 71 include the first information (a print object 74), the second information (indicated by an arrow 77), and the third information (a printable area 73). Unlike in the case of the label 61, a distance S from a first direction downstream edge 72 of the label 71 to a first direction downstream edge 75 of the printable area 73 is shorter than the distance L. Therefore, in a case where the distance S and the distance L are compared in the same manner as in the case that was described above, the heat-sensitive tape 8 may be fed by the distance L in the second direction before the printing is started.

In this case, based on the first information, the CPU 11 may specify a position 76 that is the position within the print object 74 that is the farthest downstream in the first direction (the direction indicated by the arrow 77). Hereinafter, the position 76 that is the farthest downstream in the first direction within the print object 74 is referred to as the starting position 76. When the printing of the print object 74 is started, it may be best for the starting position 76 to be positioned at the thermal line head 112. In that case, the label creation device 1 may print the print object 74 on the heat-sensitive tape 8 as the heat-sensitive tape 8 is fed in the first direction. Accordingly, the CPU 11 may specify the distance from the first direction downstream edge 72 of the label 71 to the specified starting position 76 as a distance T. The CPU 11 may compare the distance T to the distance L and may determine whether or not to feed the heat-sensitive tape 8 in the second direction before the printing starts.

Figure 11:
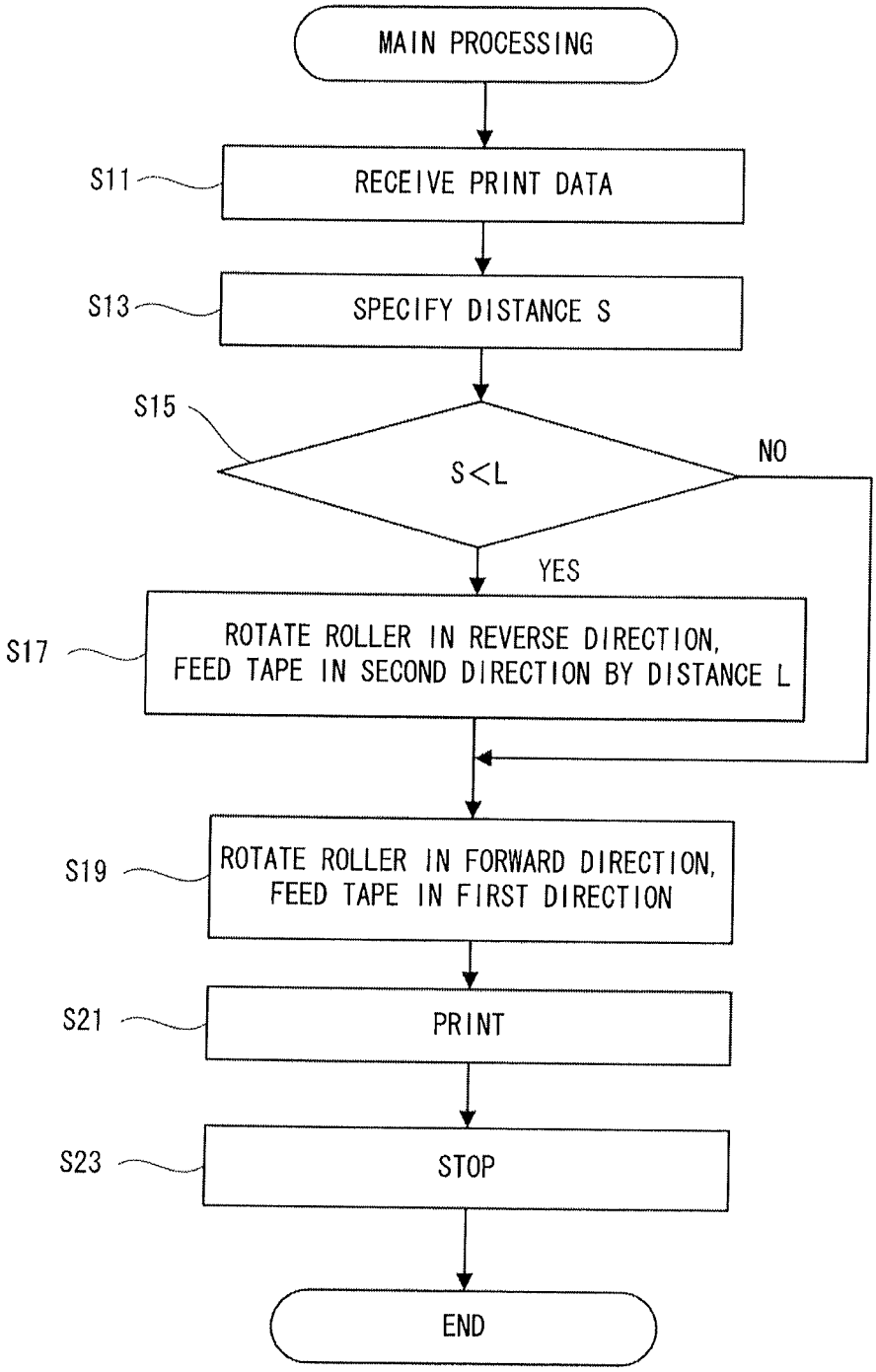
FIG. 11 is a flowchart that shows main processing.

In a case where the distance T, instead of the distance S, is compared to the distance L, the distance T, instead of the distance S, may be compared to the distance L at Step S15 in the main processing that is shown in FIG. 11. In a case where the distance T is not less than the distance L (NO at Step S15), it is acceptable for the heat-sensitive tape 8 not to be fed in the second direction. In that case, the CPU 11 may print the print object 74 starting from the starting position 76 as the heat-sensitive tape 8 is fed in the first direction. Therefore, the processing may advance to Step S19 without the CPU 11 having performed the processing that feeds the heat-sensitive tape 8 in the second direction by the distance L. In a case where the distance T is less than the distance L (YES at Step S15), it is necessary to feed the heat-sensitive tape 8 in the second direction in order to print the print object 74 on the heat-sensitive tape 8 starting from the starting position 76. The CPU 11 may cause the platen roller 111 (refer to FIG. 6 and the like) to be rotated in the reverse direction and may cause the heat-sensitive tape 8 to be fed in the second direction by the distance L (Step S17). Then the processing may advance to Step S19. The rest of the processing may be the same as in the case where the distance S is compared to the distance L, so an explanation will be omitted.

As explained above, by comparing the distance T to the distance L, the label creation device 1 may specify more appropriately whether or not the heat-sensitive tape 8 may be fed in the second direction before the printing is started. If the distance T is not less than the distance L, it is acceptable for the processing that feeds the heat-sensitive tape 8 in the second direction before the printing of the label 71 is started not to be performed, even in a case where the distance S is less than the distance L. The reason why is that, even in this case, it is possible to print the print object 74 on the heat-sensitive tape 8. Therefore, the label creation device 1 may further shorten the time that is required in order to create the label 71.

In the embodiment that is described above, when the heat-sensitive tape 8 is fed in the second direction prior to the printing, the heat-sensitive tape 8 may always be fed by the distance L. As an alternative to this, the label creation device 1 may adjust the distance that the heat-sensitive tape 8 is fed in the second direction, such that the position where the printing is to be started is positioned at the thermal line head 112. In addition, in the same manner as in a case where the distance S is not less than the distance L, the label creation device 1 may adjust the distance that the heat-sensitive tape 8 is fed in the first direction, such that the position where the printing is to be started is positioned at the thermal line head 112. This is described in detail below.

The main processing in a modified example will be explained with reference to FIG. 13. In a case where it is determined at Step S15 that the distance S is less than the distance L (YES at Step S15), the CPU 11 causes the heat-sensitive tape 8 to be fed in the second direction by a distance (L−S) that is computed by subtracting the distance S from the distance L (Step S31). On the other hand, in a case where it is determined that the distance S is not less than the distance L (NO at Step S15), the CPU 11 causes the heat-sensitive tape 8 to be fed in the first direction by a distance (S−L) that is computed by subtracting the distance L from the distance S (Step S33). The rest of the processing is the same as the main processing in FIG. 11, so an explanation will be omitted.

Figure 13:
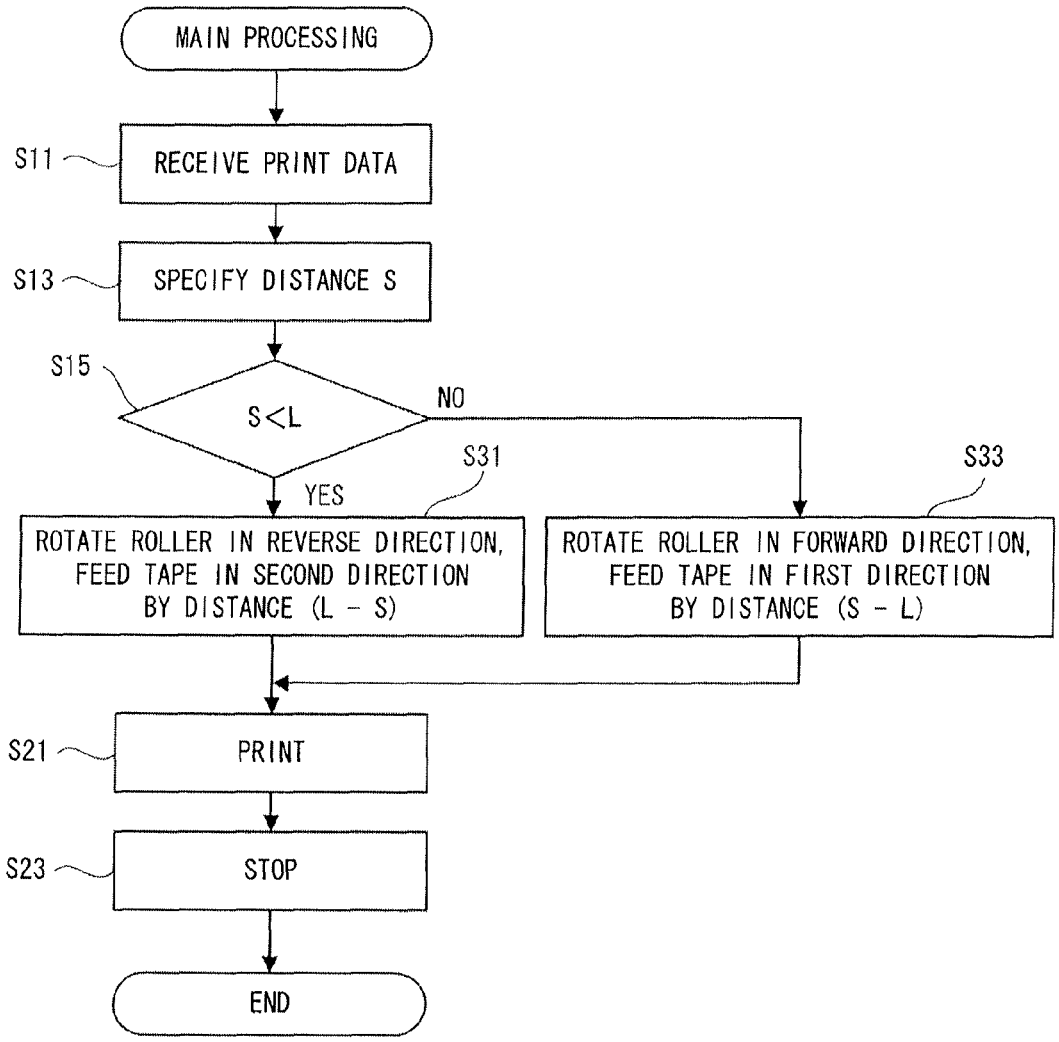
FIG. 13 is a flowchart that shows main processing in a modified example.

As an example, a case is considered in which the main processing that is shown in FIG. 13 is performed, and the printing is performed on the heat-sensitive tape 8 based on the print data for the label 71 that is shown in FIG. 12. In this case, at the stage prior to the start of the printing (refer to FIG. 7), a position 78 that is separated from the first direction downstream edge 72 of the label 71 by the distance L (refer to FIG. 12) may be positioned at the thermal line head 112. Therefore, the heat-sensitive tape 8 may be fed in the second direction by the distance (L−S). The first direction downstream edge 75 of the printable area 73 may thus be positioned at thermal line head 112. This makes it possible for the label creation device 1 to start feeding the heat-sensitive tape 8 in the first direction and to perform the printing right away. The label creation device 1 may thus shorten the distance that the heat-sensitive tape 8 is fed in the second direction. Therefore, the time that is required in order to create the label may be shortened even more.

As another example, a case is considered in which the main processing that is shown in FIG. 13 is performed, and the printing is performed on the heat-sensitive tape 8 based on the print data for the label 61 that is shown in FIG. 10. In this case, at the stage prior to the start of the printing (refer to FIG. 7), a position 67 that is separated from the first direction downstream edge 62 of the label 61 by the distance L may be positioned at the thermal line head 112. Therefore, the heat-sensitive tape 8 may be fed in the first direction by the distance (S−L). The first direction downstream edge 65 of the printable area 63 may thus be positioned at thermal line head 112. This makes it possible for the label creation device 1 to start feeding the heat-sensitive tape 8 in the first direction and to perform the printing right away. Thus, by feeding the heat-sensitive tape 8 to a position where the printing can be started right away, the label creation device 1 may shorten even more the time that is required in order to create the label.

In the main processing that is shown in FIG. 13, the distance T may be used instead of the distance S. That is, in a case where it is determined at Step S15 that the distance T is less than the distance L (YES at Step S15), the CPU 11 may cause the heat-sensitive tape 8 to be fed in the second direction by a distance (L−T) that is computed by subtracting the distance T from the distance L (Step S31). In a case where it is determined that the distance T is not less than the distance L (NO at Step S15), the CPU 11 may cause the heat-sensitive tape 8 to be fed in the first direction by a distance (T−L) that is computed by subtracting the distance L from the distance T (Step S33). The performing of the feeding processing in this manner may position the starting position 76 (refer to FIG. 12) at the thermal line head 112. Therefore, the label creation device 1 may cause the heating elements of the thermal line head 112 to be heated while the label creation device 1 causes the heat-sensitive tape 8 to be fed in the first direction. The label creation device 1 may thus start the printing right away. Therefore, the label creation device 1 may shorten even more the time that is required in order to create the label.

In the explanation above, the determination of whether or not to feed the heat-sensitive tape 8 in the second direction may be made by comparing one of the distance S and the distance T to the distance L. However, the label creation device 1 may determine whether or not to feed the heat-sensitive tape 8 in the second direction by comparing another parameter to the distance L. The heat-sensitive tape 8 may be a long paper tape. The heat-sensitive tape 8 may be a pre-cut paper tape. In a case where a pre-cut paper tape is used, the label creation device 1 may set the parameter for determining whether or not to feed the heat-sensitive tape 8 in the second direction based on a length of the pre-cut paper in a direction in which the pre-cut paper is to be fed. With the label creation device 1, the user may cut the heat-sensitive tape 8 by manually pressing the heat-sensitive tape 8 against the cutting blade 160. As an alternative to this, the label creation device 1 may create the label 7 by cutting the heat-sensitive tape 8 automatically after the printing on the heat-sensitive tape 8 has been performed.

In a case where the label creation device 1 feeds the heat-sensitive tape 8 in the second direction by the distance L, it is not necessary for the distance that the heat-sensitive tape 8 is fed to be precisely the distance L. The distance that the heat-sensitive tape 8 is fed may be slightly shorter than the distance L. For example, in a case where the distance L is 7 millimeters, the amount that the heat-sensitive tape 8 is fed in the second direction may be defined as 6 millimeters. Similarly, in a case where the label creation device 1 feeds the heat-sensitive tape 8 in the second direction by one of the distance (L−S) and the distance (L−T), it is not necessary for the distance that the heat-sensitive tape 8 is fed to be precisely the one of the distance (L−S) and the distance (L−T). The distance that the heat-sensitive tape 8 is fed may be slightly shorter or slightly longer than the one of the distance (L−S) and the distance (L−T).

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A label creation device comprising:

a feeding portion that is configured to feed a printing medium in a first direction and a second direction, the second direction being an opposite direction from the first direction;

a printing portion that is configured to perform printing on the printing medium fed in the first direction by the feeding portion;

a cutting portion that is provided downstream in the first direction from the printing portion and that is configured to cut the printing medium in order to create a label by cutting off a printed portion of the printing medium that is fed by the feeding portion, the printed portion being a portion of the printing medium on which the printing has been performed by the printing portion; and a processor that is configured to specify a first distance, which is a length of a blank portion in the first direction, the blank portion being a portion of the printing medium on which the printing is not performed and that is provided downstream in the second direction from a cut position, the cut position being a position of the printing medium where the printing medium is cut by the cutting portion, determine if a second distance is greater than the specified first distance, the second distance being a distance between the printing portion and the cutting portion;

control the feeding portion to feed the printing medium in the second direction by an amount that depends on the second distance before the printing of the label is performed in response to determining that the second distance is greater than the specified first distance and control the feeding portion not to feed the printing medium in the second direction, before printing of the label is performed, in response to determining that the second distance is not greater than the first distance.

2. The label creation device according to claim 1, wherein the processor is configured to specify, as the first distance, a distance on the printing medium from the cut position to a position that is the farthest downstream in the first direction within a printable area of the label, based on information that indicates the printable area.

3. The label creation device according to claim 1, wherein the processor is configured to specify, as the first distance, a distance on the printing medium from the cut position to a position that is the farthest downstream in the first direction within a print object that is to be printed on the printing medium.

4. The label creation device according to claim 1, wherein the amount is the second distance in a case where the second distance is greater than the first distance.

5. The label creation device according to claim 1, wherein the amount is computed by the processor by subtracting the first distance from the second distance in a case where the second distance is greater than the first distance.

6. The label creation device according to claim 1, wherein the processor is configured to control the feeding portion to feed the printing medium in the first direction by a distance computed by subtracting the second distance from the first distance, before the printing of the label is performed, in a case where the second distance is not greater than the first distance.

7. A non-transitory computer-readable medium storing a control program executable on a label creation device, the program comprising computer-readable instructions, when executed, to cause the label creation device to perform the steps of:

specifying a first distance, which is a length of a blank portion in a first direction, the blank portion being a portion of a printing medium on which the printing is not performed by a printing portion of the label creation device and that is provided downstream in the second direction form a cut position, the cut position being a position of the printing medium where the printing medium is cut by a cutting portion of the label creation device, a feeding portion being configured to feed a printing medium in the first direction and a second direction, the second direction being an opposite direction from the first direction, the printing portion being configured to perform printing on the printing medium fed in the first direction by the feeding portion, the cutting portion being provided downstream in the first direction from the printing portion and being configured to cut the printing medium in order to create a label by cutting off a printed portion of the printing medium that is fed by the feeding portion, and the printed portion being a portion of the printing medium on which the printing has been performed by the printing portion;

determining if a second distance is greater than the specified first distance, the second distance being a distance between the printing portion and the cutting portion;

controlling the feeding portion to feed the printing medium in the second direction by an amount that depends on the second distance before the printing of the label is performed in response to determining that the second distance is greater than the specified first distance; and controlling the feeding portion not to feed the printing medium in the second direction, before printing of the label is performed, in response to determining that the second distance is not greater than the first distance.

8. The non-transitory computer-readable medium according to claim 7, wherein a distance on the printing medium from the cut position to a position that is the farthest downstream in the first direction within a printable area of the label is specified as the first distance based on information that indicates the printable area.

9. The non-transitory computer-readable medium according to claim 7, wherein a distance on the printing medium from the cut position to a position that is the farthest downstream in the first direction within a print object that is to be printed on the printing medium is specified as the first distance.

10. The non-transitory computer-readable medium according to claim 7, wherein the amount is the second distance in a case where the second distance is greater than the first distance.

11. The non-transitory computer-readable medium according to claim 7, wherein the amount is computed by the processor subtracting the first distance from the second distance in a case where the second distance is greater than the first distance.

12. The non-transitory computer-readable medium according to claim 7, wherein the feeding portion is controlled to feed the printing medium in the first direction by a distance computed by subtracting the second distance from the first distance, before the printing of the label is performed, in a case where the second distance is not greater than the first distance.

* * * * *